US010679499B2

(12) United States Patent
Kwon

(10) Patent No.: US 10,679,499 B2
(45) Date of Patent: Jun. 9, 2020

(54) TRAFFIC GUIDANCE SYSTEM AND METHOD THEREOF

(71) Applicants: HYUNDAI MOTOR COMPANY, Seoul (KR); KIA MOTORS CORPORATION, Seoul (KR)

(72) Inventor: Su Jin Kwon, Suwon-Si (KR)

(73) Assignees: HYUNDAI MOTOR COMPANY, Seoul (KR); KIA MOTORS CORPORATION, Seoul (KR)

( * ) Notice: Subject to any disclaimer, the term of this patent is extended or adjusted under 35 U.S.C. 154(b) by 0 days.

(21) Appl. No.: 16/195,364

(22) Filed: Nov. 19, 2018

(65) Prior Publication Data

US 2020/0090513 A1 Mar. 19, 2020

(30) Foreign Application Priority Data

Sep. 14, 2018 (KR) ..... 10-2018-0110121

(51) Int. Cl.
*G08G 1/0968* (2006.01)
*G08G 1/01* (2006.01)

(52) U.S. Cl.
CPC ..... *G08G 1/096805* (2013.01); *G08G 1/012* (2013.01); *G08G 1/0125* (2013.01)

(58) Field of Classification Search
CPC ..... G08G 1/096805; G08G 1/012; G08G 1/0125; G08G 1/096741; G08G 1/096716; G08G 1/096791; G08G 1/162; G08G 1/09; G08G 1/22; G08G 1/096725; G08G 1/163; G01C 21/3407; G05D 1/0088; G05D 1/0223; G05D 1/0285
See application file for complete search history.

(56) References Cited

U.S. PATENT DOCUMENTS

2011/0309926 A1* 12/2011 Eikelenberg ..... G01C 21/3469 340/439
2015/0170522 A1* 6/2015 Noh ..... G08G 1/096741 701/117
2017/0272450 A1* 9/2017 Krishnamurthi .... H04L 63/1416

* cited by examiner

*Primary Examiner* — Anne Marie Antonucci
*Assistant Examiner* — Andrew J Cromer
(74) *Attorney, Agent, or Firm* — Morgan, Lewis & Bockius LLP

(57) ABSTRACT

A traffic guidance system includes: a vehicle terminal located in each vehicle and configured to obtain brake information; a collection server configured to collect the brake information; and a control server configured to search for a driving route to a destination point based on a request of the vehicle terminal and provide the found driving route. The control server is configured to: analyze the brake information collected by the collection server; generate brake pattern information for each traffic situation; and search for the driving route using the generated brake pattern information for each traffic situation.

20 Claims, 6 Drawing Sheets

TRAFFIC GUIDANCE SYSTEM AND METHOD THEREOF

CROSS-REFERENCE TO RELATED APPLICATION

This application is claims the benefit of priority to Korean Patent Application No. 10-2018-0110121, filed in the Korean Intellectual Property Office on Sep. 14, 2018, the entire contents of which are incorporated herein by reference.

TECHNICAL FIELD

The present disclosure relates to a traffic guidance system for determining traffic situations by analyzing brake patterns of vehicles and searching for a route.

BACKGROUND

A navigation system can check an accurate distance to a destination point and a time taken to reach the destination point and then search for an optimal route to the destination point to perform route guidance. The navigation system may search for a driving route to the destination point based on real-time traffic information and statistical traffic information to guide a driver to the destination point along the found driving route.

When a congested situation occurs due to occurrence of a sudden accident and the like, a conventional navigation system takes time to collect and reflect such a change in traffic situation in real time. As such, when a sudden congested section occurs, it is difficult to reflect the congested section in traffic information, so that conventional technologies are difficult to avoid the sudden congested section.

SUMMARY

The present disclosure has been made to solve the above-mentioned problems occurring in the prior art while advantages achieved by the prior art are maintained intact.

An aspect of the present disclosure provides a traffic guidance system for analyzing a brake pattern of a vehicle, recognizing a section where a traffic event, such as congestion or an accident, occurs, and searching for a route in consideration of the section where the traffic event occurs and a method thereof.

The technical problems to be solved by the present inventive concept are not limited to the aforementioned problems, and any other technical problems not mentioned herein will be clearly understood from the following description by those skilled in the art to which the present disclosure pertains.

According to an aspect of the present disclosure, a traffic guidance system may include: a vehicle terminal located in each vehicle and configured to obtain brake information; a collection server configured to collect the brake information; and a control server configured to search for a first driving route to a destination point based on a request of the vehicle terminal and provide the found driving route. The control server may be configured to analyze the brake information collected by the collection server, generate first brake pattern information for each traffic situation, and search for the first driving route using the first brake pattern information.

The vehicle terminal may include a brake sensor configured to sense operation of a brake, a communication device configured to perform wireless communication with the collection server and the control server, and a processor configured to obtain the brake information using the brake sensor and instruct the communication device to transmit the obtained brake information to the collection server.

The brake information may include a time when the brake operates and a time when the brake is released.

The control server may be configured to analyze a driving route on which a specific vehicle previously travels, recognize a section, where a rate of variation in vehicle deceleration and a rate of variation in the frequency of brake operations depart from a reference range, as a section where a brake pattern is collected, and analyze brake information of the recognized section to generate brake pattern information.

The control server may be configured to fail to collect brake pattern information of the recognized section, when the recognized section corresponds to any one of a speed enforcement zone, a school zone, and a section where the number of traffic lights per unit section is greater than or equal to a criterion.

The control server may be configured to classify the recognized section at intervals of a predetermined time and calculate the frequency of brake operations and a brake operation time for each classified section to generate the brake pattern information.

The control server may be configured to compare the generated brake pattern information with previously stored brake pattern information for each traffic situation, collect the generated brake pattern information, when similarity between the generated brake pattern information and the previously stored brake pattern information is greater than or equal to a criterion, and fail to collect the generated brake pattern information, when the similarity between the generated brake pattern information and the previously stored brake pattern information is less than the criterion.

The control server may be configured to collect brake pattern information of at least one or more other vehicles which travel on the same section in the same time as the collection of the generated brake pattern information and average the generated brake pattern information and the brake pattern information of the at least one or more other vehicles to generate the brake pattern information for each traffic situation.

The control server may be configured to, when detecting a section where an event occurs, including brake pattern information similar above a reference rate to the brake pattern information for each traffic situation, on the found driving route, recalculate an estimated time in consideration of the section where the event occurs and provide a driving route in which the section is reflected.

The control server may be configured to, when a vehicle is not predicted to enter the section where the event occurs within a predetermined period, recalculate a time taken to pass through the section where the event occurs at the predetermined period and perform route recalculation.

The control server may be configured to, when the vehicle is predicted to enter the section where the event occurs within the predetermined period, immediately perform route recalculation.

According to another aspect of the present disclosure, a traffic guidance method may include: collecting, by a collection server, brake information from at least one or more vehicles; analyzing, by a control server, the brake information collected by the collection server to generate first brake pattern information for each traffic situation; searching, by the control server, for a first driving route using the first brake pattern information for each traffic situation based on a request of a vehicle terminal; and providing, by the control server, the first driving route to the vehicle terminal.

The brake information may include a time when a brake operates and a time when the brake is released.

The deriving of the brake pattern information for each traffic situation may include analyzing a driving route on which a specific vehicle previously travels and recognizing a section, where a rate of variation in vehicle deceleration and a rate of variation in the frequency of brake operations depart from a reference range, as a section where a brake pattern is collected, analyzing brake information of the recognized section to generate brake pattern information, and collecting brake pattern information of at least one or more other vehicles which travel on the same section in the same time as the collection of the generated brake pattern information and averaging the generated brake pattern information and the brake pattern information of the at least one or more other vehicles to generate the brake pattern information for each traffic situation.

The generating of the brake pattern information may include failing to collect brake pattern information of the recognized section, when the recognized section corresponds to any one of a speed enforcement zone, a school zone, and a section where the number of traffic lights per unit section is greater than or equal to a criterion.

The generating of the brake pattern information may include classifying the recognized section at intervals of a predetermined time and calculating the frequency of brake operations and a brake operation time for each classified section to generate the brake pattern information.

The generating of the brake pattern information may include comparing the generated brake pattern information with previously stored brake pattern information for each traffic situation, collecting the generated brake pattern information, when similarity between the generated brake pattern information and the previously stored brake pattern information is greater than or equal to a criterion, and failing to collect the generated brake pattern information, when the similarity between the generated brake pattern information and the previously stored brake pattern information is less than the criterion.

The searching for the driving route may include, when detecting a section where an event occurs, including brake pattern information similar above a reference rate to the brake pattern information for each traffic situation, on the found driving route, recalculating an estimated time in consideration of the section where the event occurs and providing a driving route in which the section is reflected.

The method may further include, when a vehicle is not predicted to enter the section where the event occurs within a predetermined period, recalculating a time taken to pass through the section where the event occurs at the predetermined period and performing route recalculation.

The method may further include, when the vehicle is predicted to enter the section where the event occurs within the predetermined period, immediately performing route recalculation.

BRIEF DESCRIPTION OF THE DRAWINGS

The above and other objects, features and advantages of the present disclosure will be more apparent from the following detailed description taken in conjunction with the accompanying drawings.

DETAILED DESCRIPTION

Hereinafter, embodiments of the present disclosure will be described in detail with reference to the accompanying drawings. In adding reference denotations to elements of each drawing, although the same elements are displayed on a different drawing, it should be noted that the same elements have the same denotations. In addition, in describing an embodiment of the present disclosure, if it is determined that a detailed description of related well-known configurations or functions blurs the gist of an embodiment of the present disclosure, it will be omitted.

In describing elements of embodiments of the present disclosure, the terms $1^{st}$, $2^{nd}$, first, second, A, B, (a), (b), and the like may be used herein. These terms are only used to distinguish one element from another element, but do not limit the corresponding elements irrespective of the nature, turn, or order of the corresponding elements. Unless otherwise defined, all terms used herein, including technical or scientific terms, have the same meanings as those generally understood by those skilled in the art to which the present disclosure pertains. Such terms as those defined in a generally used dictionary are to be interpreted as having meanings equal to the contextual meanings in the relevant field of art, and are not to be interpreted as having ideal or excessively formal meanings unless clearly defined as having such in the present application.

When there is a change in traffic situation due to occurrence of a traffic event such as congestion or an accident, an embodiment of the present disclosure may analyze brake patterns of vehicles which are traveling on a section where the traffic event occurs to quickly and accurately recognize the change in traffic situation and may derive brake pattern information for each traffic situation. Furthermore, an embodiment of the present disclosure may quickly and accurately recognize a section where a traffic event, such as congestion or an accident, occurs, using brake pattern information for each traffic situation derived when searching for a route to a destination point and may provide a route for avoiding or bypassing the section. Herein, the brake pattern information for each traffic situation may include brake pattern information for each road type and/or section. For example, congestion situation brake pattern information may include congestion situation brake pattern information on a highway and congestion situation brake pattern information on a national highway. The brake pattern information for each traffic situation may be updated on a periodic basis.

Figure 1:
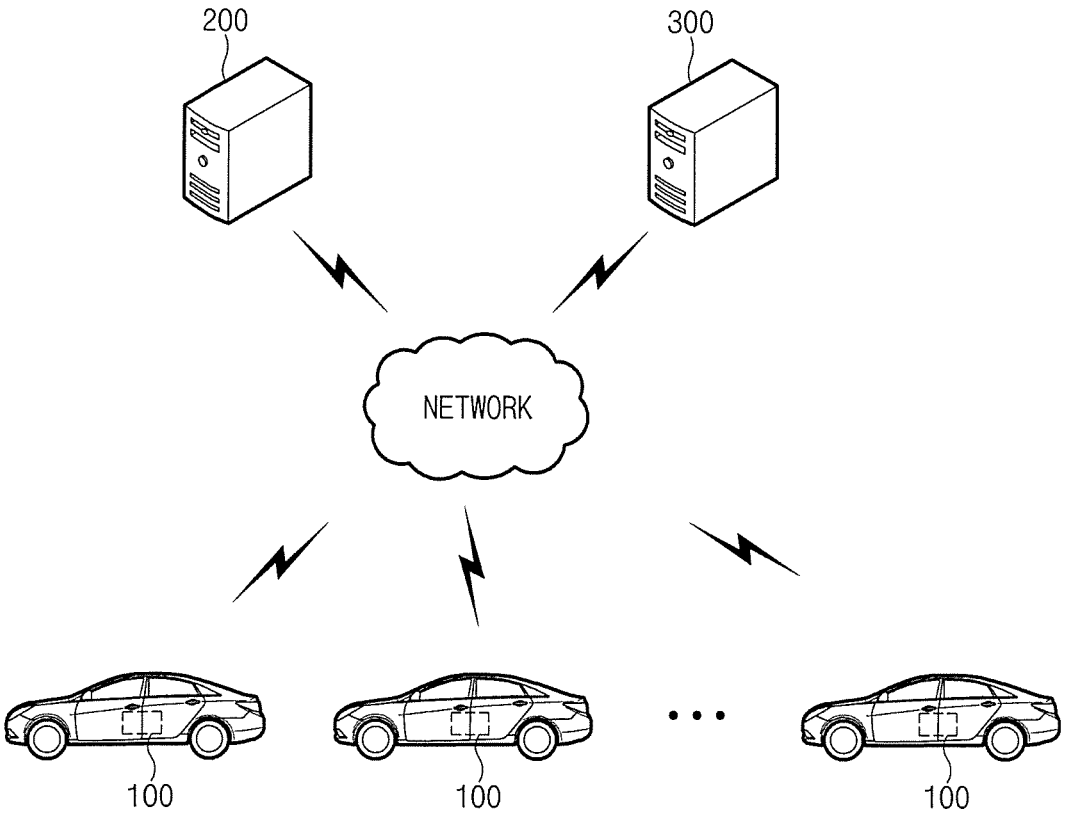
FIG. 1 is a drawing illustrating a configuration of a traffic guidance system according to an embodiment of the present disclosure.
Figure 2:
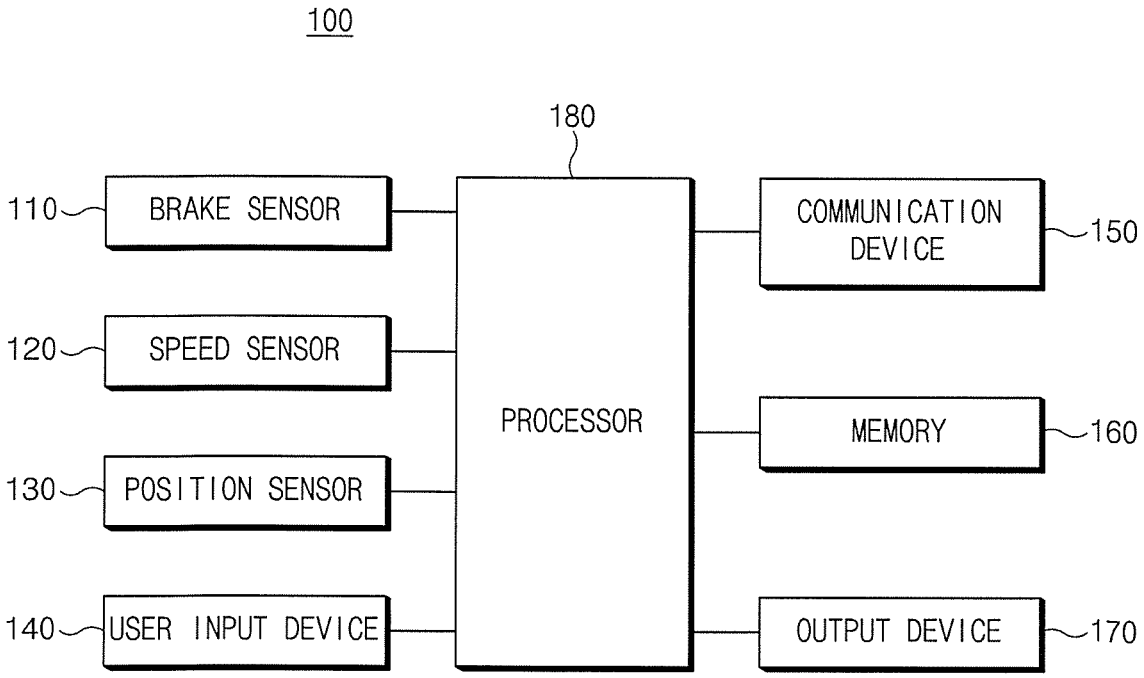
FIG. 2 is a block diagram illustrating a configuration of a vehicle terminal shown in FIG. 1.
Figure 3:
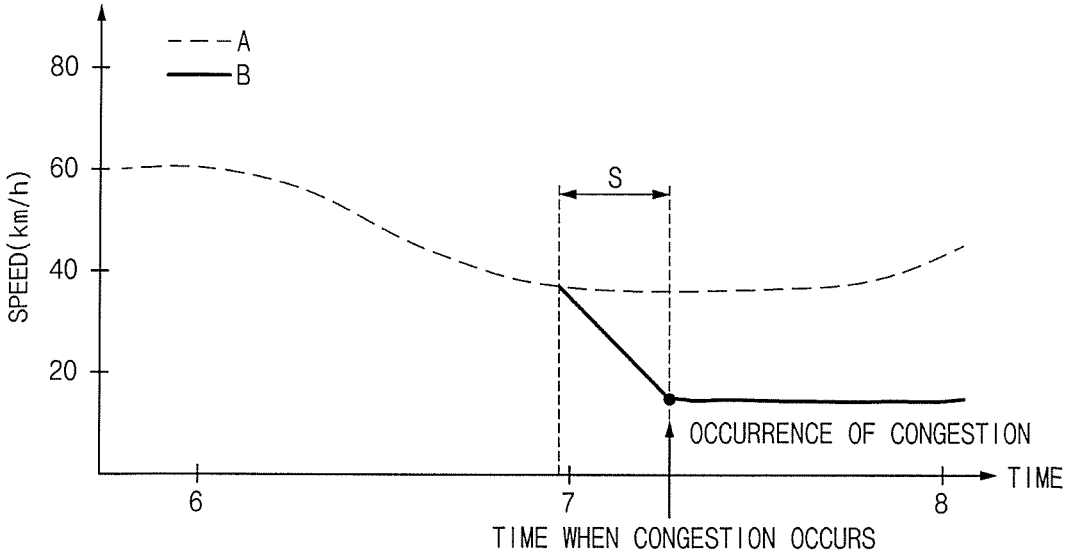
FIG. 3 is a graph illustrating a section where a brake pattern is collected, associated with according to an embodiment of the present disclosure.
Figure 4:
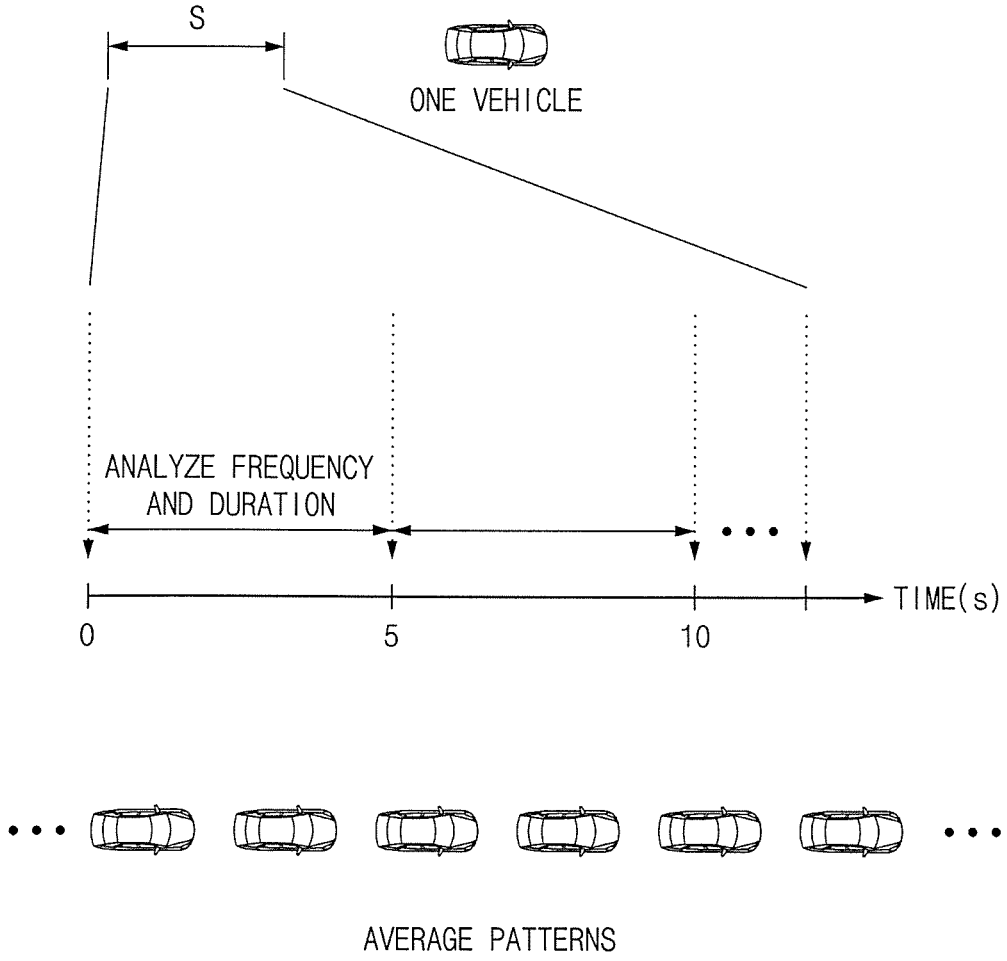
FIG. 4 is a graph illustrating a brake pattern analysis method associated with according to an embodiment of the present disclosure.

FIG. 1 is a drawing illustrating a configuration of a traffic guidance system according to an embodiment of the present disclosure. FIG. 2 is a block diagram illustrating a configuration of a vehicle terminal 100 shown in FIG. 1. FIG. 3 is a graph illustrating a section where a brake pattern is collected, associated with according to an embodiment of the present disclosure. FIG. 4 is a graph illustrating a brake pattern analysis method associated with according to an embodiment of the present disclosure.

Referring to FIG. 1, the traffic guidance system may include a vehicle terminal 100, a collection server 200, and a control server 300.

The vehicle terminal 100 may be a device, located in each vehicle, which provides a navigation service to a user (driver) and may be implemented with at least one or more of electronic devices, for example, a smartphone, a tablet, a personal digital assist (PDA), an audio video navigation (AVN) terminal, an in-vehicle infotainment terminal, and a telematics terminal.

The vehicle terminal 100 may request the control server 300 to search for a route and may guide the user along a driving route provided from the control server 300. When requesting to search for the route, the vehicle terminal 100 may transmit information, such as identification information of the vehicle terminal 100, vehicle identification information, a departure point, and a destination point, together.

The vehicle terminal 100 may obtain brake information in real time while a vehicle travels. The brake information may include a time when a brake operates, a time when the brake is released, a location of a brake pedal, and/or the like. Herein, the time when the brake operates may refer to a time when the driver starts to depress the brake pedal. The time when the brake is released may refer to a time when the driver takes his or her foot off the brake pedal.

The vehicle terminal 100 may transmit the obtained brake information to the collection server 200. The vehicle terminal 100 may transmit brake information obtained at a predetermined period (e.g., 5 minutes) to the collection server 200.

Such a vehicle terminal 100 may include, as shown in FIG. 2, a brake sensor 110, a speed sensor 120, a position sensor 130, a user input device 140, a communication device 150, a memory 160, an output device 170, and a processor 180.

The brake sensor 110 may sense operation of the brake pedal. The brake sensor 110 may measure a position of the brake pedal, that is, a degree to which the brake pedal is depressed. The processor 180 may detect whether the brake pedal operates, using the brake sensor 110. The processor 180 may detect whether the brake pedal operates, using an electronic control unit (ECU) loaded into the vehicle.

The speed sensor 120 may be loaded into the vehicle to measure a speed of the vehicle (a vehicle speed). The speed sensor 120 may be implemented with a wheel speed sensor, an acceleration sensor, and/or the like. An embodiment of the present disclosure is exemplified as the vehicle speed is measured using the speed sensor 120. However, embodiments are not limited thereto. For example, a vehicle speed may be obtained using an ECU, such as an automatic transmission, an auto brake system (ABS), and a vehicle speed warning device, loaded into the vehicle.

The position sensor 130 may measure a current position of the vehicle terminal 100, that is, a vehicle position. The position sensor 130 may be implemented as a global positioning system (GPS) receiver. The GPS receiver may calculate a vehicle position using signals transmitted from three or more GPS satellites. The GPS receiver may calculate a distance between a satellite and the GPS receiver using a time difference between a time when the satellite transmits a signal and a time when the GPS receiver receives the signal. The GPS receiver may calculate a vehicle position using the calculated distance between the satellite and the GPS receiver and position information of the satellite, included in the transmitted signal.

The brake sensor 110, the speed sensor 120, and the position sensor 130 may be collectively called a vehicle information detector. The vehicle information detector may obtain vehicle information using each of the sensors 110, 120, and 130, the ECU, and the like and may transmit the obtained vehicle information to the processor 180.

The user input device 140 may receive a control command (e.g., a route search command) and/or data from the user. The user input device 140 may receive information about a departure point and/or a destination point from the user. The user input device 140 may be implemented as a keyboard, a keypad, a button, a switch, a touch pad, a touch screen, and/or the like.

The communication device 150 may perform wireless communication with the collection server 200 and the control server 300 of FIG. 1. Herein, wireless internet technology, such as a wireless local area network (WLAN) (wireless-fidelity (Wi-Fi)), wireless broadband (Wibro), and/or world interoperability for microwave access (Wimax), and/or mobile communication technology, such as code division multiple access (CDMA), global system for mobile communication (GSM), long term evolution (LTE), and/or LTE-advanced, may be used as wireless communication technology.

The memory 160 may store software programmed for the processor 180 to perform a predetermined operation or may store input and/or output data of the processor 180. The memory 160 may store data measured by the sensors 110, 120, and 130. The memory 160 may store predetermined configuration information, map data, and the like.

The memory 160 may be implemented with at least one or more of storage media, for example, a flash memory, a hard disk, a secure digital (SD) card, a random access memory (RAM), a static RAM (SRAM), a read only memory (ROM), a programmable ROM (PROM), an electrically erasable and programmable ROM (EEPROM), an erasable and programmable ROM (EPROM), a register, and a removable disk.

The output device 170 may output a state and result processed according to an operation of the processor 180 as optical information, acoustic information, haptic information, and/or the like. The output device 170 may include a display, a sound output module, a haptic module, and the like.

The display may implemented with one or more of a liquid crystal display (LCD), a thin film transistor-LCD (TFT LCD), an organic light-emitting diode (OLED) display, a flexible display, a three-dimensional (3D) display, a transparent display, a head-up display (HUD), a touch screen, and a cluster.

The sound output module may be implemented as a speaker which outputs audio data previously stored in the memory 160. The haptic module may output a signal in a form where the user may recognize with his or her tactile sense, for example, vibration.

The output device 170 may display map navigation information (route guidance) under control of the processor 180 and may output a navigation voice signal via the sound output module.

The processor 180 may control an overall operation of the vehicle terminal 100. The processor 180 may be implemented with at least one or more of an application specific integrated circuit (ASIC), a digital signal processor (DSP), programmable logic devices (PLD), field programmable gate arrays (FPGAs), a central processing unit (CPU), microcontrollers, and microprocessors.

The processor 180 may request the control server 300 to search for a route, based on a user input which is input through the user input device 140. When requesting to search for the route, the processor 180 may transmit a request message, including identification information of the vehicle terminal 100 (or vehicle identification information), a departure point (a vehicle position), a destination point, a route search method (an optimal route, a shortest distance, a minimum distance, and the like), and the like, to the control server 300.

After requesting to search for the route, the processor 180 may receive route information, transmitted from the control server 300, via the communication device 150. The processor 180 may perform route guidance based on the received route information. The processor 180 may overlay and display a route where a vehicle will travel with map data.

When the vehicle starts to travel, the processor 180 may obtain information indicating whether a brake pedal operates, a vehicle speed, and a vehicle position, using the brake sensor 110, the speed sensor 120, and the position sensor 130. In other words, the processor 180 may obtain vehicle information using the vehicle information detector.

When the operation of the brake pedal is sensed by the brake sensor 110, the processor 180 may measure a time (time point) when a brake operates, using a clock (not shown) included in the vehicle terminal 100. When the operation of the brake pedal is released, the processor 180 may measure a time (time point) where the brake is released, using the clock (not shown). The processor 180 may measure a time when the brake pedal is depressed and a time when a foot is separated from the brake pedal, using the brake sensor 110 and the clock (not shown).

The processor 180 may transmit brake information, including information such as a time when a brake operates and a time when the brake is released, to the collection server 200 via the communication device 150. The processor 180 may transmit identification information of the vehicle terminal 100, vehicle identification information, and/or driving route identification information (i.e., a number assigned when the control server 300 provides a driving route) together.

The collection server 200 may collect brake information transmitted from the at least one or more vehicle terminals 100. In other words, the collection server 200 may collect brake information from at least one or more vehicles. The collection server 200 may store and manage the collected information in a database. The collection server 200 may transmit and receive data with the control server 300 through wired and/or wireless communication. Herein, a local area network (LAN), a wide area network (WAN), an Ethernet, an integrated services digital network (ISDN), and/or the like may be used as wired communication technology. Wireless Internet technology, mobile communication technology, and/or the like may be used as wireless communication technology.

As the vehicle terminal 100 requests to search for a route, the control server 300 may search for a driving route from a current position (a departure point) of the vehicle to a destination point of the vehicle and may provide the found driving route. The control server 300 may execute a route search based on information, such as a departure point, a destination point, and a route search method (a minimum time, an optimal route, a shortest distance, and the like) included in a route search request message.

The control server 300 may search for a route in consideration of brake pattern information other than real-time traffic information and statistical traffic information (pattern traffic information). Herein, the statistical traffic information may refer to the result of analyzing a travel speed pattern in a specific section and/or a specific time zone based on real-time traffic information.

The control server 300 may analyze a brake pattern of each vehicle using brake information collected by the collection server 200 to derive (generate) brake pattern information for each traffic situation. Herein, the traffic situation may refer to a congestion situation, a situation where an accident occurs, or the like. The control server 300 may monitor brake patterns of vehicles for each road type and/or each section using brake pattern information for each traffic situation. The control server 300 may monitor brake patterns of vehicles which are traveling for each road type and/or each section in real time and may recognize (detect) a section where a traffic event, such as an accident or congestion, occurs (e.g., a section where congestion occurs or where an accident occurs). When the section where the traffic event occurs is recognized, the control server 300 may search for a route capable of bypassing or avoiding the section and may provide the found route.

In other words, the control server 300 may analyze a brake pattern in real time using brake pattern information for each traffic situation. When the vehicle is predicted to enter a congestion section or an accident section, the control server 300 may search for a route capable of bypassing or avoiding the section and may provide the found route.

The control server 300 may analyze a past driving route of a specific vehicle to generate brake pattern information for each traffic situation and may determine a section where a brake pattern is collected (hereinafter referred to as "collection section"). The control server 300 may analyze a travel speed pattern of a past driving route and may determine a section, where a rate of variation in vehicle deceleration and/or a rate of variation in the frequency of brake operations departs from a reference range, as a collection section. For example, as shown in FIG. 3, when a travel speed of a past driving route is mostly smooth like "A", the control server 300 may fail to collect brake pattern information. On the other hand, when a travel speed of a past driving route decelerates rapidly in a specific interval S like "B", the control server 300 may recognize the interval S as a collection section. The control server 300 may receive brake information of the recognized collection section from the collection server 200.

The control server 300 may analyze the brake information provided from the collection server 200 and may generate brake pattern information of the recognized collection section. The brake pattern information may include the frequency of brake operations and a brake operation time. Herein, the frequency of brake operations may refer to the number of times that a brake pedal is depressed during a unit time (e.g., 5 seconds) per unit distance (e.g., 50 m). The brake operation time may refer to duration when the brake pedal is depressed.

Referring to FIG. 4, the control server 300 may classify the recognized collection section S at intervals of a predetermined time (e.g., 5 seconds). The control server 300 may calculate the frequency of brake operations and a brake operation time for each classified section (at intervals of the classified time) to generate brake pattern information.

The control server 300 may compare the generated brake pattern information with previously stored brake pattern information for each traffic situation. When similarity between the generated brake pattern information and the previously stored brake pattern information is greater than or equal to a criterion, the control server 300 may collect the generated brake pattern information. When the similarity between the generated brake pattern information and the previously stored brake pattern information is less than the criterion, the control server 300 may exclude the generated brake pattern information from a collection target. In other words, when the similarity between the generated brake pattern information and the previously stored brake pattern information is less than the criterion, the control server 300 may fail to collect the generated brake pattern information.

When the recognized collection section S is a section where a brake is depressed irrespective of a congestion situation, for example, a speed enforcement zone, a school zone, or a section where the number of traffic lights per unit section is greater than or equal to a criterion, the control server 300 may fail to collect brake pattern information of the section.

When the generated brake pattern information is similar above a criterion to the previously stored brake pattern information for each traffic situation, the control server 300 may collect the generated brake pattern information. The control server 300 may collect brake pattern information of a specific vehicle and may then collect brake pattern information of at least one or more other vehicles (a vehicle group) which travel on the same section in the same time as the collection of the brake pattern information of the specific vehicle. The control server 300 may average the collected brake pattern information of the specific vehicle (a first vehicle) and the collected brake pattern information of the at least one or more other vehicles to generate (derive) brake pattern information for each traffic situation. The control server 300 may update old brake pattern information for each traffic situation to the generated brake pattern information for each traffic situation.

The control server 300 may perform an initial one-time search based on a request of a driver and may perform route recalculation per predetermined period (e.g., 5 minutes). The control server 300 may immediately perform route recalculation based on a compulsory recalculation request of the driver or when a specific event occurs.

When performing an initial route search based on a request of the driver, the control server 300 may search for a driving route to a destination point based on real-time traffic information and statistical traffic information. The control server 300 may verify whether there is a section where brake pattern information similar above a reference rate to brake pattern information for each traffic situation is detected on the found driving route. When the found driving route includes the section where the brake pattern information similar above the reference rate to the brake pattern information for each traffic situation is detected, the control server 300 may predict congestion will soon start and recalculate an estimated time, thus reflecting the estimated time in a route to provide the final driving route.

When performing route recalculation over a predetermined period, the control server 300 may monitor a brake pattern of a vehicle group which is traveling on a driving route in real time and may recognize a section, where brake pattern information similar above a predetermined reference rate to brake pattern information for each traffic situation is detected, as a section where an event occurs. The control server 300 may determine whether the vehicle is predicted to enter the recognized section where the event occurs within a predetermined period. When the vehicle is not predicted to enter the section where the event occurs within the predetermined period, the control server 300 may re-recognize a section where an event occurs, where brake pattern information similar to brake pattern information for each traffic situation is detected per predetermined period and may perform route recalculation in consideration of the re-recognized section where the event occurs.

When the vehicle is predicted to enter the section where the event occurs within the predetermined period, the control server 300 may immediately re-search for a route of avoiding or bypassing the section where the event occurs.

Figure 6:
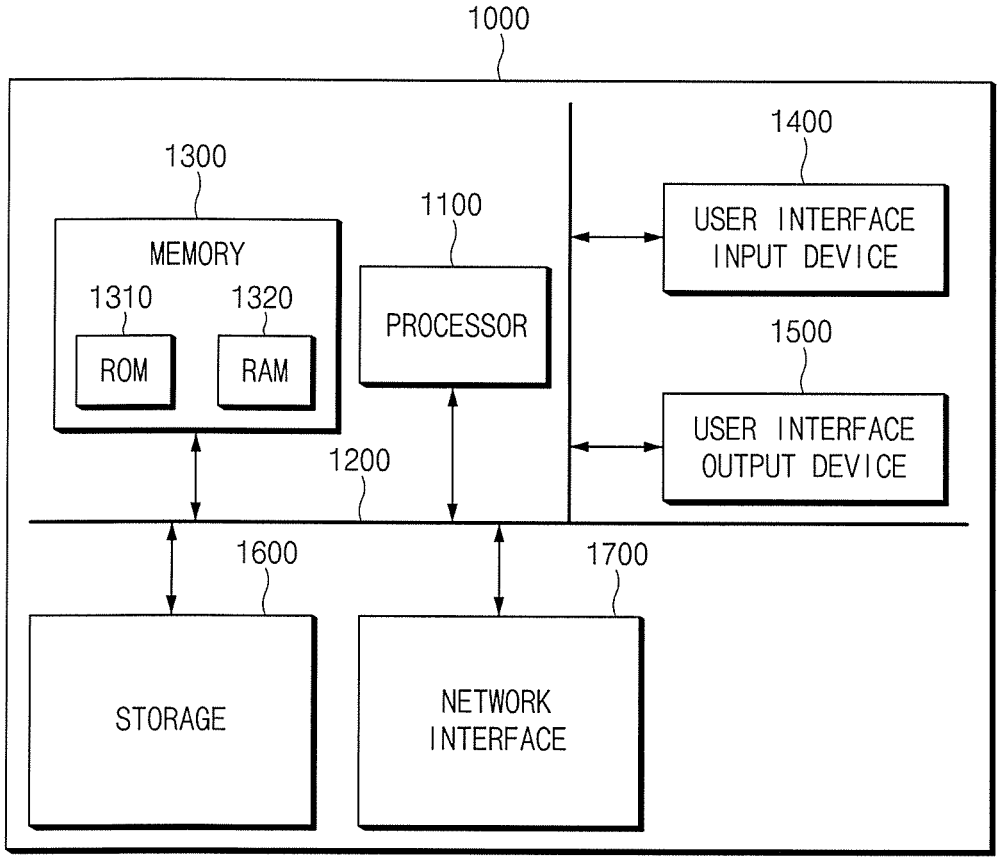
FIG. 6 is a block diagram illustrating a configuration of a computing system which executes a traffic guidance method according to an embodiment of the present disclosure.

Each of the collection server 200 and the control server 300 may be implemented as a computing system shown in FIG. 6. Furthermore, the above-mentioned embodiment is exemplified as the collection server 200 for collecting brake information of each vehicle is provided independently. However, embodiments are not limited thereto. For example, the control server 300 may be implemented to collect brake information of each vehicle.

Figure 5:
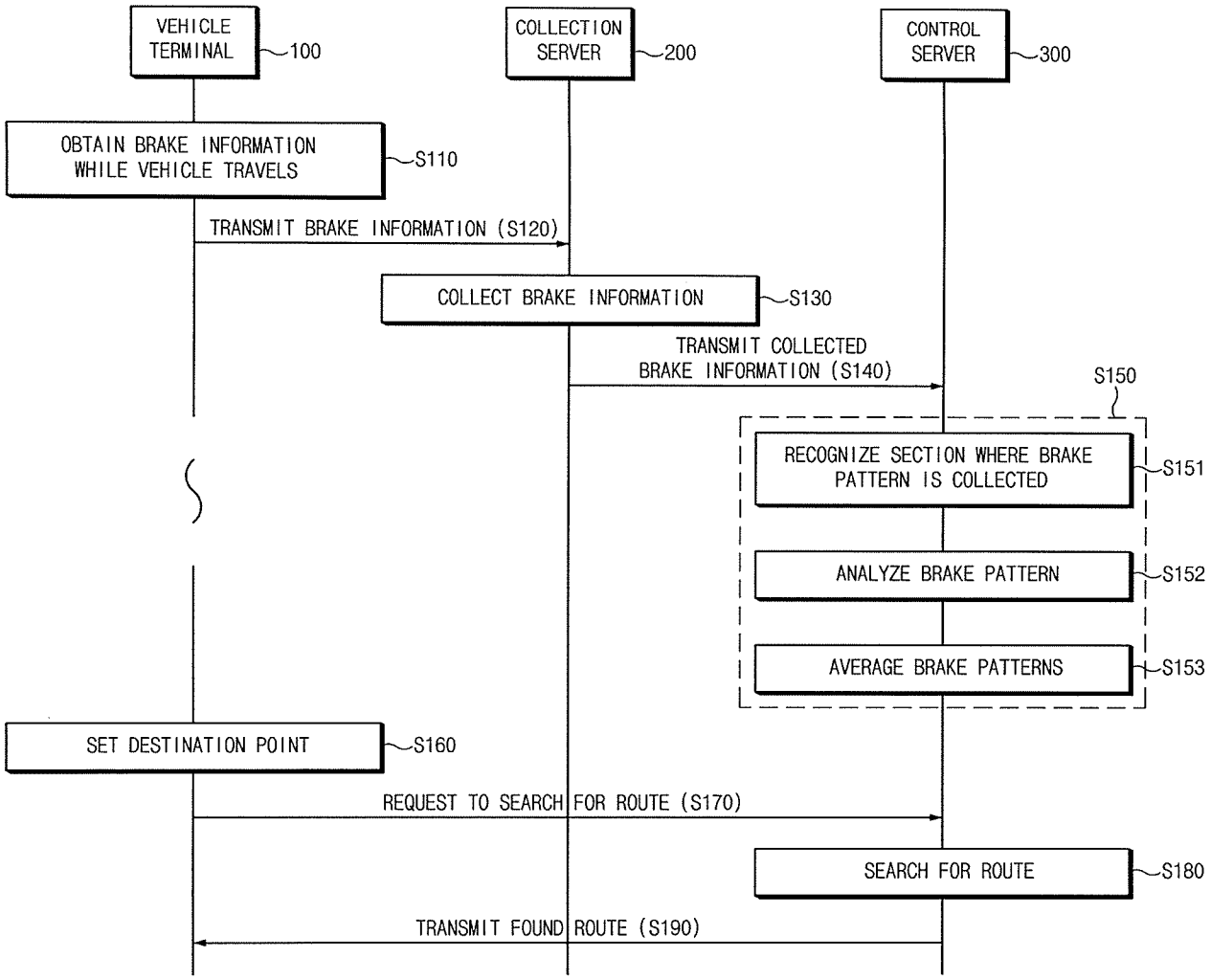
FIG. 5 is a signal sequence diagram illustrating a traffic guidance method according to an embodiment of the present disclosure.

FIG. 5 is a signal sequence diagram illustrating a traffic guidance method according to an embodiment of the present disclosure.

First of all, in operation S110, a vehicle terminal 100 may obtain brake information while a vehicle travels. A processor 180 of the vehicle terminal 100 may obtain brake information including a time when a brake operates and a time when the brake is released, using a brake sensor 110 of FIG. 2.

In operation S120, the vehicle terminal 100 may transmit the obtained brake information to a collection server 200 of FIG. 1. The processor 180 of the vehicle terminal 100 may transmit the brake information at a predetermined period through a communication device 150 of FIG. 2.

In operation S130, the collection server 200 may collect the brake information transmitted from the vehicle terminals 100. The collection server 200 may receive brake information from at least one or more vehicles and may store and manage the received brake information in a database.

In operation S140, the collection server 200 may transmit the received brake information to a control server 300 of FIG. 1. The collection server 200 may transmit the collected brake information based on a request of the control server 300 or may transmit the collected brake information at a predetermined period. Alternatively, the collection server 200 may transmit the brake information to the control server 300 concurrently with collecting the brake information.

In operation S150, the control server 300 may analyze a brake pattern of each vehicle using the collected brake information provided from the collection server 200.

In operation S151, the control server 300 may analyze a past driving route of a specific vehicle and may recognize a section where a brake pattern is collected. The control server 300 may recognize a section, where a rate of variation in vehicle deceleration and a rate of variation in the frequency of brake operations depart from a reference range on the past driving route of the specific vehicle, as a section where a brake pattern is collected.

In operation S152, the control server 300 may analyze a brake pattern of the specific vehicle using brake information of the recognized section where the brake pattern is collected. In other words, the control server 300 may classify the recognized section at intervals of a predetermined time and may calculate the frequency of brake operations and a brake operation time for each classified section to generate brake pattern information.

The control server 300 may compare brake pattern information generated to determine whether the generated brake pattern information is valid with previously stored brake pattern information for each traffic situation. When similarity between the generated brake information and the previously stored brake pattern information is greater than or equal to a criterion as a result of the comparison, the control server 300 may determine that the generated brake pattern information is valid and may collect the generated brake pattern information.

When the similarity between the generated brake information and the previously stored brake pattern information is less than the criterion as a result of the comparison, the control server 300 may determine that the generated brake pattern information is invalid and may fail to collect the generated brake pattern information.

Furthermore, when the recognized section where the brake pattern is collected corresponds to a section such as a speed enforcement zone, a school zone, or a section where the number of traffic lights per unit section is greater than or equal to a criterion, the control server 300 may fail to collect brake pattern information of the section.

In operation S153, the control server 300 may average brake pattern information of at least one or more other vehicles which travel on the same section in the same time as the collected brake pattern information to generate brake pattern information for each traffic situation. In this case, the control server 300 may collect the generated brake pattern information of a specific vehicle and may collect brake pattern information of at least one or more other vehicles which travel on the same section in the same time as the specific vehicle. The control server 300 may average the collected brake pattern information. The control server 300 may continuously analyze brake patterns of vehicles and may update brake pattern information for each traffic situation.

In operation S160, the vehicle terminal 100 may set a destination point based on an input of a driver. The vehicle terminal 100 may be located in a request vehicle which requests to search for a route.

When the destination point is set, in operation S170, the vehicle terminal 100 may request the control server 300 to search for a route. When requesting to search for the route, the vehicle terminal 100 may transmit information, such as identification information of the vehicle terminal 100, a current location (departure point) of a vehicle, a destination point of the vehicle, together.

In operation S180, the control server 300 may search for a driving route to the destination point using brake pattern information for each traffic situation based on the request of the vehicle terminal 100. In operation S190, the control server 300 may transmit the found driving route to the vehicle terminal 100 of the request vehicle. The vehicle terminal 100 may guide the driver along the driving route provided from the control server 300.

When receiving the request to search for the route from the vehicle terminal 100, the control server 300 may search for a driving route using real-time traffic information and statistical traffic information. The control server 300 may verify whether there is a section where an event occurs, where brake pattern information similar above a reference rate (e.g., 80%) to brake pattern information for each traffic situation, on the found driving route. When the found driving route includes the section where the event occurs, where the brake pattern information similar above the reference rate to the brake pattern information for each traffic situation is detected, the control server 300 may calculate an estimated time taken to reach a destination point in consideration of the event. Furthermore, the control server 300 may search for a route of avoiding or bypassing the section where the event occurs and may provide the found route.

Thereafter, the control server 300 may perform route recalculation at a predetermined period. In other words, the control server 300 may analyze a brake pattern of a vehicle group which travels on a driving route in real time and may compare the analyzed brake pattern with brake pattern information for each traffic situation. The control server 300 may recognize a section where an event occurs, where similarity between the analyzed brake pattern information and the brake pattern information for each traffic situation is greater than or equal to a criterion. When the section where the event occurs is recognized, the control server 300 may verify whether the request vehicle is able to enter the section where the event occurs within a predetermined period.

When the request vehicle is unable to enter the section where the event occurs within the predetermined period, the control server 300 may recalculate a time taken to pass through the section where the event occurs within the predetermined period. The control server 300 may re-search a route of avoiding or bypassing the section where the event occurs.

When the host vehicle is able to enter the section where the event occurs within the predetermined period, the control server 300 may immediately perform route recalculation and may provide a route of avoiding or bypassing the section.

The control server 300 may monitor brake patterns of vehicles which are traveling in real time and may recognize occurrence of a traffic event such as a traffic accident or congestion. When the traffic event is a traffic accident, the control server 300 may transmit a signal of notifying the driver that the accident occurs to vehicles predicted to enter the section such that a secondary accident does not occur. Moreover, the control server 300 may simultaneously transmit an emergency signal to a police control center and/or an emergency center to deal with an accident quickly.

FIG. 6 is a block diagram illustrating a configuration of a computing system which executes a traffic guidance method according to an embodiment of the present disclosure.

Referring to FIG. 6, a computing system 1000 may include at least one processor 1100, a memory 1300, a user interface input device 1400, a user interface output device 1500, a storage 1600, and a network interface 1700, which are connected with each other via a bus 1200.

The processor 1100 may be a central processing unit (CPU) or a semiconductor device for processing instructions stored in the memory 1300 and/or the storage 1600. Each of the memory 1300 and the storage 1600 may include various types of volatile or non-volatile storage media. For example, the memory 1300 may include a read only memory (ROM) and a random access memory (RAM).

Thus, the operations of the methods or algorithms described in connection with the embodiments disclosed in the specification may be directly implemented with a hardware module, a software module, or combinations thereof, executed by the processor 1100. The software module may reside on a storage medium (e.g., the memory 1300 and/or the storage 1600) such as a RAM, a flash memory, a ROM, an erasable and programmable ROM (EPROM), an electrically EPROM (EEPROM), a register, a hard disc, a removable disc, or a compact disc-ROM (CD-ROM). An exemplary storage medium may be coupled to the processor 1100. The processor 1100 may read out information from the storage medium and may write information in the storage medium. Alternatively, the storage medium may be integrated with the processor 1100. The processor and storage medium may reside in an application specific integrated circuit (ASIC). The ASIC may reside in a user terminal. Alternatively, the processor and storage medium may reside as a separate component of the user terminal.

According to the embodiment of the present disclosure, the traffic guidance system may analyze a brake pattern of a vehicle and may recognize a section where a traffic event, such as congestion or an accident, occurs, thus quickly and accurately determining a traffic situation.

According to the embodiment of the present disclosure, the traffic guidance system may analyze a brake pattern of a vehicle and may recognize a section where a traffic event, such as congestion or an accident, occurs, thus providing a bypass or avoidance route to vehicles predicted to enter the section such that the vehicles avoid the section where the traffic event occurs.

Hereinabove, although the present disclosure has been described with reference to exemplary embodiments and the accompanying drawings, the present disclosure is not limited thereto, but may be variously modified and altered by those skilled in the art to which the present disclosure pertains without departing from the spirit and scope of the present disclosure claimed in the following claims.

What is claimed is:

1. A traffic guidance system, the system comprising:

a vehicle terminal located in each vehicle and configured to obtain brake information;

a collection server configured to collect the brake information; and a control server configured to search for a first driving route to a destination point based on a request of the vehicle terminal and to provide the first driving route, wherein the control server:

analyzes the brake information collected by the collection server;

generates first brake pattern information for each traffic situation;

recognizes occurrence of a traffic event based on the first brake pattern information; and searches for the first driving route taking into account the occurrence of the traffic event.

2. The system of claim 1, wherein the vehicle terminal comprises:

a brake sensor configured to sense operation of a brake;

a communication device configured to perform wireless communication with the collection server and the control server; and a processor configured to:

obtain the brake information using the brake sensor; and instruct the communication device to transmit the obtained brake information to the collection server.

3. The system of claim 2 wherein the brake information comprises a first time when the brake operates and a second time when the brake is released.

4. The system of claim 1; wherein, when searching for the first driving route, the control server:

analyzes a second driving route on which a specific vehicle previously traveled;

recognizes a section, when a rate of variation in vehicle deceleration and a rate of variation in frequency of brake operations depart from reference ranges, respectively, at which a brake pattern is collected; and analyzes brake information of the recognized section to generate second brake pattern information.

5. The system of claim 4, wherein, when the recognized section corresponds to any one of a speed enforcement zone, a school zone, and a section having a number of traffic lights per unit section greater than or equal to a criterion, the control server does not collect the second brake pattern information of the recognized section.

6. The system of claim 4, wherein the control server:

classifies the recognized section at intervals of a predetermined time; and calculates the frequency of brake operations and a brake operation time for each classified section to generate the second brake pattern information.

7. The system of claim 6, wherein the control server: compares the second brake pattern information with previously stored third brake pattern information for each traffic situation;

collects the second brake pattern information, when a comparison result between the second brake pattern information and the third brake pattern information is greater than or equal to a criterion; and does not collect the second brake pattern information, when the comparison result between the second brake pattern information and the third brake pattern information is less than the criterion.

8. The system of claim 7, wherein the control server: collects fourth brake pattern information of at least one or more other vehicles which travel on the same section when collecting the second brake pattern information; and averages the second brake pattern information and the fourth brake pattern information to generate the first brake pattern information for each traffic situation.

9. The system of claim 1, wherein the control server:

when detecting an event occurrence section which includes fifth brake pattern information on the first driving route, recalculates an estimated time in consideration of the event occurrence section, wherein the fifth brake pattern information has a difference from the first brake pattern information for each traffic situation which is smaller than a reference value; and provides a third driving route reflecting the section at which the event occurs.

10. The system of claim 9, wherein the control server: when a vehicle is not predicted to enter the section at which the event occurs within a predetermined period, recalculates a time taken to pass through the section at which the event occurs at the predetermined period; and performs route recalculation.

11. The system of claim 10, wherein the control server: when the vehicle is predicted to enter the section at which the event occurs within the predetermined period, immediately performs the route recalculation.

12. A traffic guidance method, the method comprising steps of:

collecting, b y a collection server, brake information from at least one or more vehicles;

analyzing, by a control server, the brake information collected by the collection server and generating first brake pattern information for each traffic situation;

recognizing, by the control server, occurrence of a traffic even based on the first brake pattern information;

searching, by the control server, for a first driving route taking into account the occurrence of the traffic event based on a request of a vehicle terminal; and providing, by the control server, the first driving route to the vehicle terminal.

13. The method of claim 12, wherein the brake information comprises a first time when a brake operates and a second time when the brake is released.

14. The method of claim 12, wherein the step of analyzing the brake information and generating the first brake pattern information comprises steps of:

analyzing a second driving route on which a specific vehicle previously traveled and recognizing a section, when a rate of variation in vehicle deceleration and a rate of variation in the frequency of brake operations depart from reference ranges, respectively, at which a brake pattern is collected;

analyzing brake information of the recognized section to generate second brake pattern information; and collecting third brake pattern information of at least one or more other vehicles which travel on the same section at the same time when collecting the second brake pattern information and averaging the second brake pattern information and the third brake pattern information to generate the first brake pattern information for each traffic situation.

15. The method of claim 14, wherein, in the step of analyzing the brake information and generating the second brake pattern information, when the recognized section corresponds to any one of a speed enforcement zone, a school zone, and a section having a number of traffic lights per unit section greater than or equal to a criterion, the control server does not collect the second brake pattern information.

16. The method of claim 14, wherein the step of analyzing the brake information and generating the second brake pattern information further comprises:

classifying the recognized section at intervals of a predetermined time; and calculating frequency of brake operations and a brake operation time for each classified section to generate the second brake pattern information.

17. The method of claim 14, wherein the step of analyzing the brake information and generating the second brake pattern information comprises:

comparing the second brake pattern information with previously stored fourth brake pattern information for each traffic situation; and collecting the second brake pattern information, when a comparison result between the second brake pattern information and the fourth brake pattern information is greater than or equal to a criterion, wherein, when the comparison result between the second brake pattern information and the fourth brake pattern information is less than the criterion, the control sever does not collect the second brake pattern information.

18. The method of claim 12, wherein the step of searching for the first driving route comprises:

when detecting an event occurrence section which includes fifth brake pattern information on the first driving route, recalculating an estimated time in consideration of the event occurrence section, wherein the fifth brake pattern information has a difference from the first brake pattern information for each traffic situation which is smaller than a reference value; and providing a third driving route reflecting the section at which the event occurs.

19. The method of claim 18, further comprising steps of:

when a vehicle is not predicted to enter the section at which the event occurs within a predetermined period, recalculating a time taken to pass through the section at which the event occurs at the predetermined period; and performing route recalculation.

20. The method of claim 19, further comprising a step of:

when the vehicle is predicted to enter the section at which the event occurs within the predetermined period, immediately performing the route recalculation.

* * * * *